US006205992B1

(12) United States Patent
Meeks et al.

(10) Patent No.: US 6,205,992 B1
(45) Date of Patent: Mar. 27, 2001

(54) ADJUSTABLE STAND FOR AN ARCHERY BOW

(76) Inventors: Randy Meeks, 2117 Orofino Creek Rd., Space 5; Bob Holzer, 1169 Shriver Rd., both of Orofino, ID (US) 83544

( * ) Notice: Subject to any disclaimer, the term of this patent is extended or adjusted under 35 U.S.C. 154(b) by 0 days.

(21) Appl. No.: 09/455,737

(22) Filed: Dec. 4, 1999

(51) Int. Cl.[7] ..... F41B 5/14
(52) U.S. Cl. ..... 124/86; 248/169
(58) Field of Search ..... 124/23.1, 86; 248/169, 248/309.1, 463

(56) References Cited

U.S. PATENT DOCUMENTS

| | | |
|---|---|---|
| D. 260,674 | 9/1981 | Simmons . |
| D. 281,344 | 11/1985 | Duke . |
| D. 297,965 | 10/1988 | Luse . |
| D. 299,199 | 1/1989 | Rogowski . |
| D. 314,303 | 2/1991 | Glaspie . |
| D. 351,209 | 10/1994 | Saunders . |
| D. 355,694 | 2/1995 | Stafford, Jr. . |
| D. 357,802 | 5/1995 | Todd . |
| D. 371,416 | 7/1996 | Bliss . |
| D. 375,993 | 11/1996 | Skinnes . |
| D. 376,832 | 12/1996 | Mills . |
| D. 382,034 | 8/1997 | Dullinger . |
| D. 386,552 | 11/1997 | Kunz . |
| D. 389,551 | 1/1998 | Fitzgerald, Jr. . |
| D. 389,552 | 1/1998 | Fitzgerald, Jr. . |
| D. 400,957 | 11/1998 | Botruff . |
| D. 406,300 | 3/1999 | Fitzgerald, Jr. . |
| D. 406,301 | 3/1999 | Fitzgerald, Jr. . |
| D. 406,302 | 3/1999 | Simpson . |
| 1,851,779 | 3/1932 | Slater . |
| 3,256,872 | 6/1966 | Koser . |
| 3,441,241 | 4/1969 | Brooks . |
| 4,054,121 | 10/1977 | Hoyt . |
| 4,087,068 | 5/1978 | Gardner . |
| 4,360,179 | 11/1982 | Roberts . |
| 4,993,398 | 2/1991 | Wallace . |
| 5,106,044 | 4/1992 | Regard . |
| 5,240,211 | 8/1993 | Anderson . |
| 5,310,150 | 5/1994 | Fecko . |
| 5,509,400 | 4/1996 | Chalin . |
| 5,547,162 | 8/1996 | Sobolewski . |
| 5,619,981 | 4/1997 | Breedlove . |
| 5,630,568 | 5/1997 | Lubrecht . |
| 5,819,462 | 10/1998 | Dockery . |

*Primary Examiner*—John A. Ricci
(74) *Attorney, Agent, or Firm*—Patent Law Office of Duncan Palmatier

(57) ABSTRACT

An adjustable archery bow stand to support a bow in a vertical position, allowing an effective support system on all types of terrain, including uneven ground; the disclosed invention has at least two legs that extend out from the front of a bow and independently adjust to keep the bow in a vertical position; in one embodiment, the legs are radially mounted to swivels that independently rotate about an axis directed out from the bow; in other embodiments the legs are adjustable in all azimuths, either by forming the legs' upper portions of a bendable material, or by multiple mechanical joints.

18 Claims, 5 Drawing Sheets

ADJUSTABLE STAND FOR AN ARCHERY BOW

BACKGROUND OF THE INVENTION

1. Field of the Invention

This invention relates to an adjustable stand for an archery bow that allows the bow to stand in a vertical position. The invention discloses a stand with two legs that extend down from the front of the bow and that with the bottom of the bow form a tripod. The legs are adjustable so that the bow will stand in a vertical position on uneven ground. The easy adjustability of the legs allows the bow to be stood up quickly in almost any terrain. The invention does not interfere with shooting or carrying the bow and makes using, storing and displaying the bow easier. The adjustability of the stand is ideal for archers, since they practice their sport outdoors, where the ground is seldom level or even.

2. Discussion of the Prior Art

An archery bow cannot stand alone. Many archers lay their bows flat on the ground or other surface. This is a particular problem for a hunter, since placing the bow flat on the ground makes picking it up a time-consuming and distracting task that may alert prey to the hunter's presence. A vertical bow is more quickly and discreetly brought to bear, especially since a modern arrow can be left on the bow's string without requiring the archer to hold it there. Thus, a stand allows the hunter to leave the bow in a vertical position at the ready with an arrow in place. For the archer practicing or participating at a tournament, a vertical bow is easier to pick up, ready, and use. Also, a free-standing bow is easier to prepare for shooting, since modern string release devices can more readily be attached with two hands.

Moreover, laying a bow on the ground can damage it by allowing debris to get entangled in the various parts of the bow, such as the string, the sights, the stabilizer, and the pulleys of a compound bow. Also, many bows are camouflaged and may not be seen easily when lying on the ground, causing them to be trampled on or tripped over. In general, archers do not want to lay their bows on the ground. By contrast, a standing bow is easier to use and see and less likely to be damaged or trodden upon. A stand also allows for easy display of the bow.

Several patents disclose stands to hold a bow in a vertical position. U.S. Pat. No. 5,547,162 ("the '162 patent") shows an archery bow stand comprised of an elongated body and a retractable leg. The elongated body attaches to the front of the bow and extends out, in the direction an arrow would travel. Most bows have a threaded hole near the center of the front, just below the grip, to attach a stabilizer or damper. The stand disclosed in the '162 patent uses that threaded hole as the attachment point for the elongated body. The retractable leg is connected to the elongated body by a spring pin near the end of the body that attaches to the bow, allowing the leg to extend downward at an angle from the body. The patent asserts that with the leg so extended the bow will stand vertically, although it is unclear how this is possible, since the invention only describes two parts that touch the ground: the bottom of the bow and the retractable leg. According to the invention described in the '162 patent, the bow would have to be propped against a vertical surface, or the retractable leg would have to be anchored to the ground, in order for the bow to stand vertically without being held by the archer or lent against some vertical object. In any event, the stand is not adjustable and will not hold a bow in a stable vertical position on uneven ground.

U.S. Pat. No. 5,106,044 shows a portable compound bow stand comprising a base plate, two legs, and a leg bracket.

The base plate attaches at the threaded stabilizer mounting hole on the front of the bow. A leg base is attached by a swivel to the bottom of the plate. The legs extend down from the leg base and are splayed out to so that the legs and the bow form a tripod. The swivel allows the legs to sweep forward and backward relative to the front of the bow. The leg support is mounted at the lower limb of the bow and holds the legs in a retracted position. Thus, when the legs are swept back, they are held in a closed position by the leg support, and when they are swept forward they provide two legs of the tripod, and the bottom of the bow forms the third leg. This patent describes and claims a stand with legs that are not adjustable for angle and height. Thus, on uneven ground the bow cannot stand in a vertical position.

U.S. Pat. No. 4,993,398 shows an archery bow support stand using two arrows as legs. An angulated cylindrical body is transversely mounted to the front of the bow and the arrows are clamped to the body and extend downward to form a tripod with the bottom of the bow. As with the other stands discussed, this invention does not provide for adjustment of the legs and will not hold the bow in a vertical position on uneven ground.

One drawback of prior art archery bow stands is that the support legs are not adjustable. Thus, on uneven ground the bow will not stand in a vertical position and will be unstable. If the terrain is especially uneven, the prior art stands may not work at all. Another drawback is that the stands have splayed legs that add to the width of the bow, making it more cumbersome to carry and store. Another drawback is that the prior art stands cannot be quickly and easily deployed.

SUMMARY OF THE INVENTION

It is one of the objects of the present invention to provide an adjustable archery bow stand that will support a bow in a vertical position on uneven ground. It is another object of the invention to provide a stand that allows the archer to deploy the bow quickly and easily. It is another object of the invention to provide a quiet, easy-to-operate stand. It is another object of the invention to provide a stand that is readily adaptable to existing bows and bow stabilizers and dampers. Other objects of the invention are to provide a stand that is light weight, that will not interfere with the operation of the bow, that may be left on the bow, that will not significantly add, if at all, to the width of the bow, that may be easily manufactured to match the coloring or camouflage of existing bows, and that will assist the archer in carrying the bow.

The invention discloses at least two legs that extend from the front of the bow and which may be readily adjusted for the angle they form with the bow. The bottom of the bow is used as one leg, thereby creating a tripod with legs that may be adjusted for the terrain. In this way, the archer can move the legs and adjust them so that the bow will stand in a vertical position. For example, hunters often wait by trees while stalking prey. The present invention allows the bow to stand in a vertical position, free from the archer's grip, with the bottom of the bow and one leg touching the ground and the other support leg extended to the side and touching the tree. By adjusting the angles of the legs the bow can be kept in a vertical position. Similarly, on uneven ground, one leg can be adjusted to an angle close to vertical while the other leg may be at an angle further from vertical in order to accommodate the terrain. In this way, the archer can rest the bow in a vertical position on any ground.

In one embodiment of the present invention, legs are mounted to the front of the bow and can independently rotate in a plane perpendicular to the bow; that is, perpendicular to the direction an arrow would fly from the bow. A main body is mounted to and extends out from the front of the bow. The main body may be attached to the bow using the stabilizer mount, which is often a threaded hole, or any other suitable mount or bracket. The main body can be any length and may itself also double as a stabilizer or damper. Each leg is attached to a separate swivel. In the preferred embodiment, a first collet swivel is rotatably mounted to the main body at the end of the body farthest from the bow. A first leg is radially mounted to the first collet swivel. Preferably, the leg will mount to the collet swivel so that it angles a little forward of the bow. As the first collet swivel rotates on the main body, the leg sweeps in a circular manner. A second collet swivel is rotatably mounted to the first collet swivel and a second leg is radially mounted to the second collet swivel. As with the first leg, the second leg may also be angled a little forward to provide added stability to the stand, just as most stools with three legs splay the legs out. As the second collet swivel rotates on the first collet swivel, the second leg also sweeps in a circular manner. In a preferred embodiment, each of the collet swivels is frictionally mounted so that the legs will stay in a set position but may be moved easily. In the preferred embodiment, this frictional mounting may be achieved by a close fit, set screws, or brake shoes; however, numerous other means for frictional mounting are well known. According to this arrangement, the angle between the legs may be adjusted and set by the archer, and that angle may be maintained even while rotating the first leg; that is, the second leg may be moved without disturbing the first leg, but moving the first leg will also move the second leg, thereby maintaining their relative positions. In the preferred embodiment, the stand is manufactured so that it will make no noise during adjustment. In the preferred embodiment, this quiet operation is achieved by making the stand out of a plastic material, such as high-impact nylon, or the like. In the preferred embodiment, each leg has a grip portion to assist the archer in moving the leg. In the preferred embodiment, the grip portion may be formed by knurling the leg or by fitting a foam sleeve over the leg. In the preferred embodiment, the bottom end, or foot, of each leg has foam cushioning to afford quiet operation and a good grip.

In an alternative embodiment, the main body is eliminated and the stand is attached to the end of a stabilizer or damper farthest from the bow. Many commercially available stabilizers and dampers have threaded holes at the end that will be farthest from the bow. Thus, the collet swivels may be connected to the far end of a stabilizer or damper directly or by means of an adapter and will otherwise operate in the manner described above.

In another embodiment of the invention, the legs are adjustable for movement in all directions, rather than only in a circle in one plane. Thus, each leg of the stand may be splayed out in any direction. For example, according to this embodiment, the bottom of the bow may rest on the ground, one leg may extend out and down from the front of the bow to rest on the ground, and another leg may extended up and back to rest against a tree or hill. Such an arrangement affords the maximum adjustability for operation of the present invention.

One embodiment of the invention that allows adjustment in all azimuths relies on bendable legs that may be moved and will stay in a particular position. This design relies on flexible materials that may be bent, that will stay in the bent position, and that may be returned the original position or another position many times, without breaking.

Other embodiments of the invention rely on mechanical systems to provide movement in all azimuths. In one such embodiment, shown in FIG. 6, each of two swivel mounts has a swivel head rotatably mounted perpendicular to the axis of the swivel mount, and each swivel head allows a leg to pivot on a pin. Thus, the swivel mount may rotate 360 degrees about a first axis directed out from the front of the bow. Each swivel head may rotate 360 degrees about a second axis perpendicular to the first axis. Finally, each pivotable leg may swing back and forth on a pin in the swivel head. With these multiple mechanical joints, the legs may be adjusted to extend in any direction.

In another embodiment of the invention, shown in FIG. 8, which permits the legs to move in all-azimuths, two swivel heads rotatably mount to the split end of a main body that extends from the front of the bow. The main body accommodates the two swivel heads which can rotate about an axis parallel to the direction of the main body. A leg is pivotably attached to each swivel head by a pin, allowing the legs to swing in an arc. The rotatable swivel heads allow the legs to move in arcs to the side of the bow as well as in front of the bow.

In another such embodiment of the invention, shown in FIG. 9, a swivel head rotatably attaches to the main body or directly to the bow or to the end of a stabilizer or damper. The head is roughly in the shape of a "T". The base of the T-head swivels about an axis directed out from the front of the bow and the top of the T-head branches into at least two tips in a generally perpendicular direction relative to the base. At each tip is a joint. A swing arm pivots on each joint so that the arm may swing back and forth in the plane of the T-head. One such mounting relies on a pin, mounted perpendicular to the plane of the T-head, on which one end of the arm may pivot. A leg is pivotably attached to the other end of each arm, allowing the legs to swing in an arc perpendicular to the plane of the T-head. With these multiple mechanical joints, the legs may be adjusted to extend in any direction.

DESCRIPTION OF THE INVENTION

Figure 1:
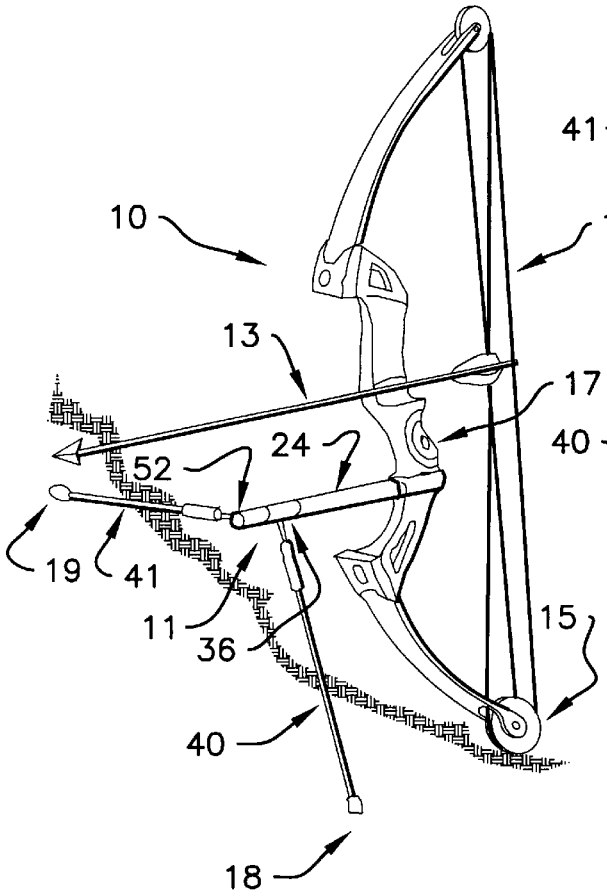
FIG. 1 is a three-quarter view of the disclosed adjustable bow stand attached to a bow and deployed, so that the bottom of the bow and one of the legs touch the ground and the other leg touches a ledge, thereby providing support to keep the bow in a vertical position on uneven ground.

FIG. 1 shows one embodiment of the present invention in operation. The adjustable archery bow stand (11) is mounted to the front of a bow (10). Most bows have a threaded hole (12) at the front of the bow (10), near the center and directly below the grip (17), for mounting a stabilizer or damper (not shown). A main body (24) extends out from the bow (10). Two legs (40 and 41) extend out from the main body (24) in generally radial directions. One leg (40) is mounted to a rear collet swivel (36) and the other leg (41) to a front collet swivel (52). The rear collet swivel (36) is rotatably mounted to the main body (24), and the front collet swivel (52) is rotatably mounted to the rear collet swivel (36). Each leg (40 and 41) is angled a little forward of the front of the bow. The adjustable stand of the present invention may be constructed of any material, but light weight materials are preferred. Preferred materials include plastics, such as high impact nylon, or metals, such as aluminum or titanium. The parts of the disclosed invention may be machined or molded. The exterior design, or product dressing, of the embodiments shown herein are non-functional and it is noted that many ornamental designs are readily available for use with the utilitarian aspects of the disclosed and claimed invention. In one example of the operation of the invention, as shown in FIG. 1, the adjustability of the stand (11) allows one of the legs (40) to touch the ground (18), a little forward and to the side of the bow (10), while allowing the other leg (41) to touch a rocky ledge (19), upward and forward of the bow (10), thus forming a tripod along with the bottom (15) of the bow (10). From this example, it may be seen that the bow (10) stands freely in a vertical position on uneven terrain. Although the bow (10) shown in FIG. 1 is a compound type, it is understood that the present invention may be adapted to any type of archery bow.

Figure 2:
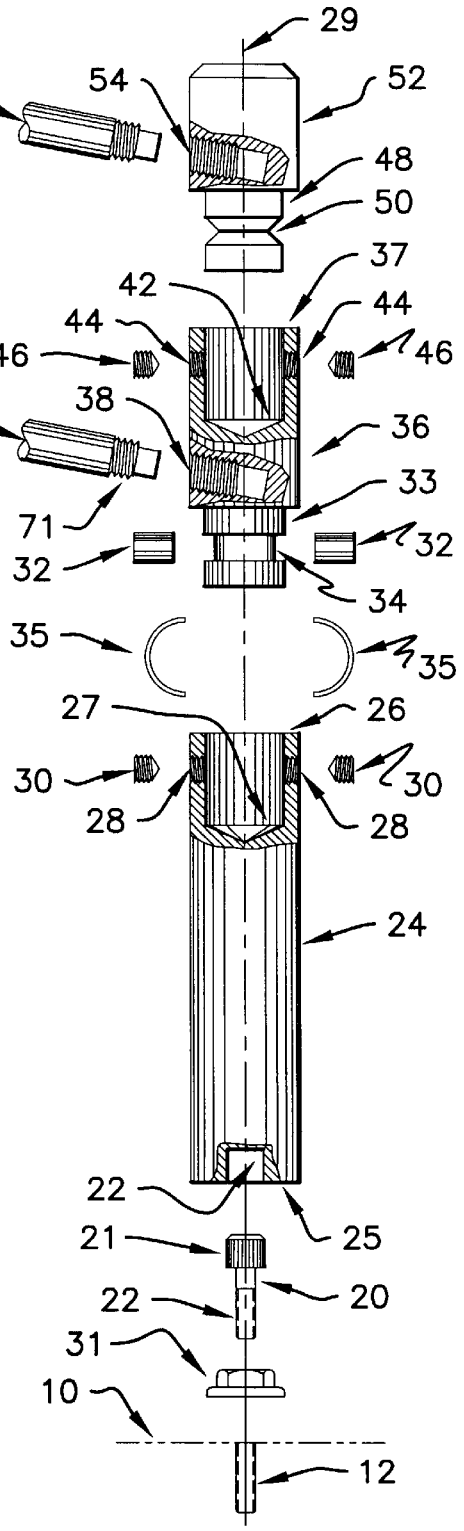
FIG. 2 is an exploded view showing the parts of the main body, collet swivels and legs of one embodiment.

FIG. 2 shows an exploded view of the parts of the above mentioned embodiment. The main body (24) has a rear end (25) and a front end (26). The adjustable stand of the present invention may be formed as part of an archery bow or may be a separate unit mountable to a bow. The adjustable bow stand shown in FIG. 2, as well as in the other figures, is a separate unit. Thus, a bolt or stud (20) is mounted to the rear end (25), allowing the invention to be mounted to the front of a bow (10). Most commercially available modern archery bows have a threaded hole (12) to mount a stabilizer or damper. The adjustable archery bow stand of the present invention may also double as a stabilizer or damper. For example, many dampers use a cylindrical body with an internal piston restrained by springs and oil (not shown). The main body (24) may incorporate such a damping mechanism. As another example, many stabilizers use weights (not shown) mounted to two legs (not shown) extending down from the front of a bow. The present invention may also incorporate such a stabilizer. Even if a bow does not have a threaded hole (12) for mounting the present invention, such a hole may be added or a bracket (not shown) may easily be adapted. The stud (20) has a splined end (21), and the rear end (25) of the main body (24) has a hole (22) for receiving the splined end (21) in a press fit. A threaded end (22) of the stud (20) screws into the threaded hole (12) at the front of the bow (10) and is secured with a lock nut (31). A mounting hole (27) at the front end (26) of the main body (24) receives the narrow end (33) of a rear collet swivel (36) and allows the rear collet swivel (36) to rotate relative to the main body (24). Two threaded holes (28) in the main body (24) receive set screws (30). The set screws (30) press against brake shoes (32) which ride in an annular groove (34) in the narrow end (33) of the rear collet swivel (36). The brake shoes are also shown by FIG. 2 in an end view (35), illustrating their semi-circular shape. The set screws (30) may be adjusted to exert pressure against the brake shoes (32), which in turn will exert friction against the annular groove (34), restraining the rear collet swivel (36) so that it will rotate according to the amount of pressure desired by the archer. The rear collet swivel (36) has a generally transverse hole (38) for mounting a leg (40). In the embodiment shown, the hole (38) and the upper end (71) of the leg (40) are threaded, although numerous other forms of attachment are possible and commonly known. In the preferred embodiment, the legs (40 and 41) are mounted at an angle slightly forward of the bow (10), so that the legs will be splayed out along with the bottom (15) of the bow (10) to form a stable tripod. A mounting hole (42) at the front end (37) of the rear collet swivel (36) receives the narrow end (48) of a front collet swivel (52) and allows the front collet swivel (52) to rotate relative to the rear collet swivel (36) and the main body (24). Two threaded holes (44) in the rear collet swivel (36) receive set screws (46). The front collet swivel (52) may be secured and restrained using the same brake shoe system described above. However, for illustrative purposes, an alternate restraining system, using fewer parts, is also shown. In the alternate restraining system shown in FIG. 2, the set screws (46) press directly against an angled groove (50) in the narrow end (48) of the front collet swivel (52), creating friction that restrains the movement of the front collet swivel (52) relative to the rear collet swivel (36). The front collet swivel (52) has a generally transverse hole (54) for mounting a leg (41). In the embodiment shown, the hole (54) and the upper end of the leg (41) are threaded. As with the rearward leg (40), in the preferred embodiment, the forward leg (41) is mounted at an angle slightly forward of the bow.

In the embodiment shown in FIG. 2, the legs may rotate in a circle about the axis (29) generally perpendicular to the front of the bow (10). The rearward leg (40) will be held in position, relative to the main body (24), by set screws (30), and the forward leg (41) will be held in position, relative to the rear collet swivel (36), by set screws (46). In operation, the archer may adjust the legs (40 and 41) independently, so that the bow (10) will stand in a vertical position, by rotating each leg (40 and 41). If desired, both legs (40 and 41) can easily be rotated to the downward direction so that they will be out of the way.

Figure 3:
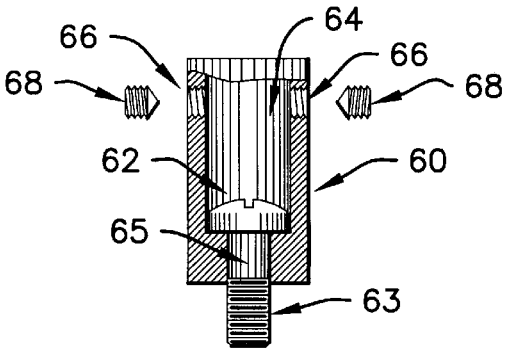
FIG. 3 is a side view of an adapter that can be used in place of the main body.

FIG. 3 shows an alternative mount for the present invention. FIG. 3 shows an adapter (60) that may be mounted to the front of a bow (10 in FIG. 2) with a bolt (62), although a stud, as shown in FIG. 2 (20), or any other form of conventional attachment is possible. The bolt (62) passes through a hole (65) in the adapter (60), and has a threaded shaft (63) that is received by the threaded hole (12 in FIG. 2) in the bow (10). A lock nut (31 in FIG. 2) may also be used, as described above. A hole (64) in the adapter (60) receives the narrow end (33 in FIG. 2) of the rear collet swivel (36 in FIG. 2). Threaded holes (66) in the adapter (60) receive set screws (68) which hold and restrain the rear collet swivel (36) in any of the manners described above. It is understood that the adapter (60) may also be used with the other embodiments described below.

Figure 4:
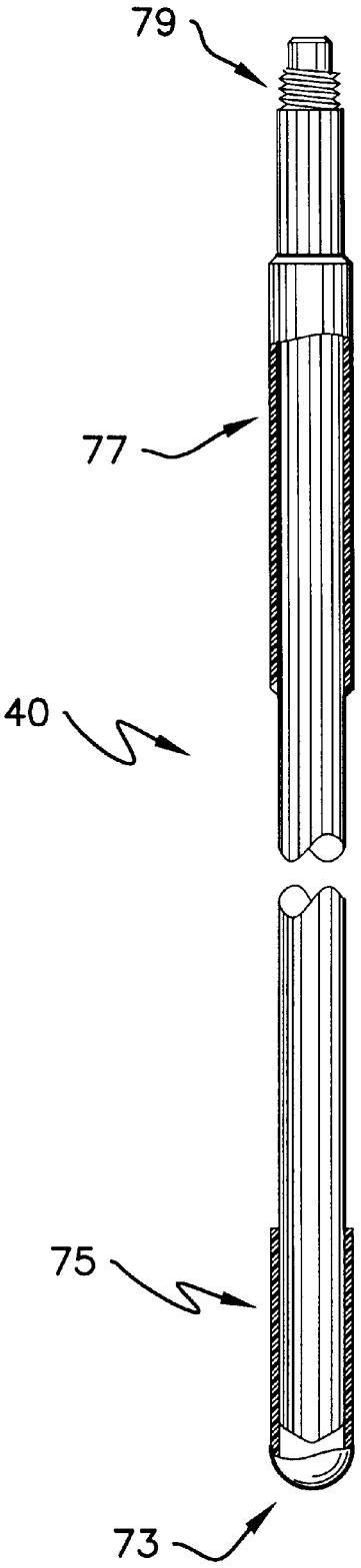
FIG. 4 shows one of the legs.
Figure 5:
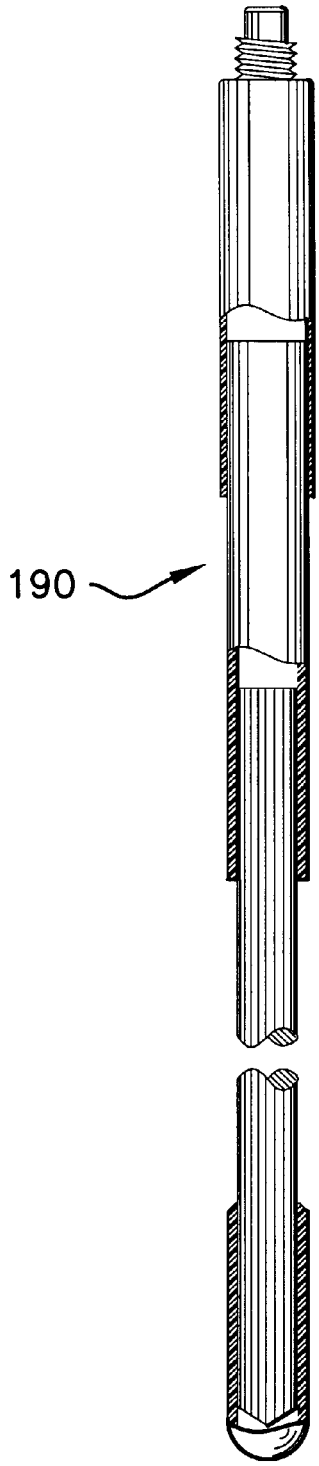
FIG. 5 shows a telescoping leg.

FIG. 4 shows a preferred embodiment applied to one of the legs (40). The leg has an upper end (71) that may be threaded (79) for attachment to the rear collet swivel (36 in FIG. 2). However, it is understood that the legs (40 and 41) may be attached to the collet swivels (36 and 52 in FIG. 2) in many other conventional ways. At the other end of the leg (40) is the foot (73), which is covered with a foam shoe (75). The foam shoe (75) provides additional grip on slick surfaces, shock absorption, and quiet operation. A foam grip (77) is provided to make adjustment of the leg easier for the archer. FIG. 5 shows an alternative embodiment applied to a leg (190). The leg (190) can be any length suitable for a particular bow or may be itself adjustable for length in the manner of camera tripods with telescoping legs, as shown.

Figure 7:
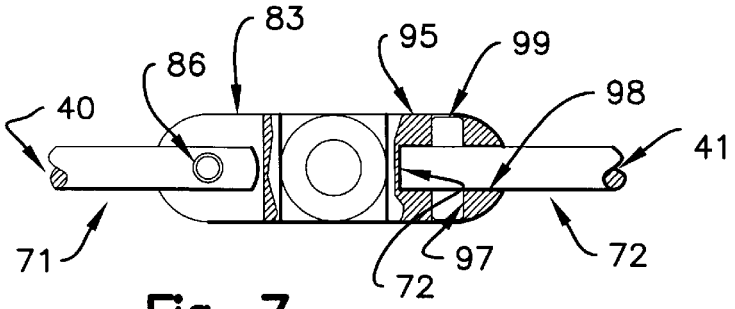
FIG. 7 is a head-on view of the alternative embodiment of the present invention shown in FIG. 6, showing the swivel heads and pivot slots adjusted in opposite directions.
Figure 6:
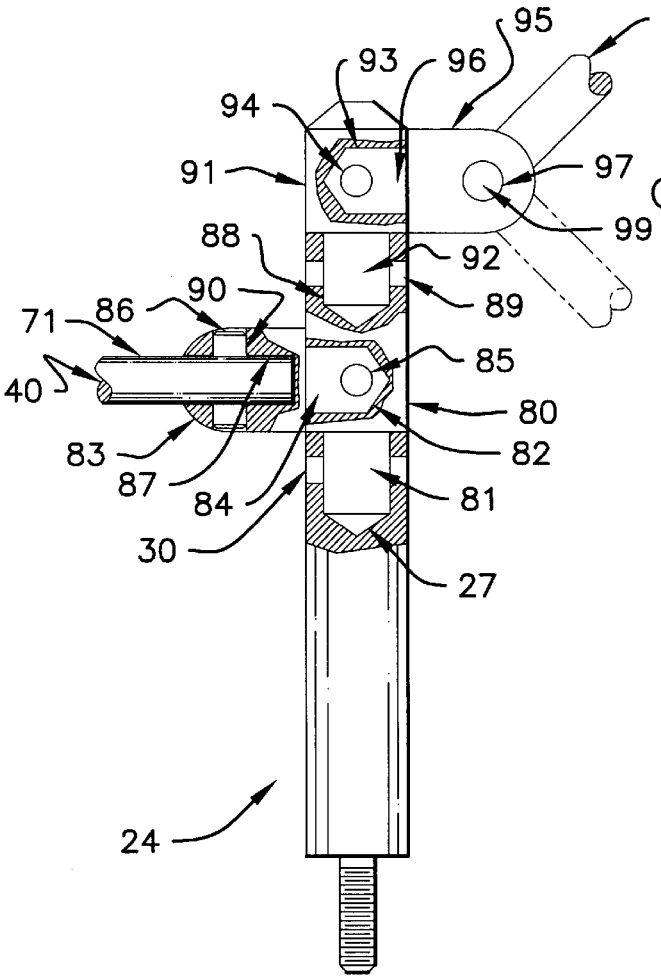
FIG. 6 is a side view of an alternative embodiment of the present invention showing the arrangement of the main body, swivel mounts, swivel heads, and pivotable legs, with one of the pivot heads directed out to one side and the other directed out to the other side.

FIGS. 6 and 7 show an alternative embodiment of the present invention. The design shown in FIGS. 6 and 7 not only permits the legs (40 and 41) to rotate about the main body (24) in the manner described above, but also permits the legs (40 and 41) to pivot forward and backward, thereby allowing adjustment in all azimuths. The main body (24), or an adapter (60 in FIG. 3), may be the same design described above. A shaft (81) of a rear swivel mount (80) is rotatably mounted in an axial hole (27) of the main body (24). Threaded holes (30) in the main body (24) receive set screws (not shown) to hold and restrain the shaft (81) of the rear swivel mount (80) in any of the same manners described above for the shaft (33) of the rear collet swivel (36) or the shaft (48) of the front collet swivel (52), as shown in FIG. 2. The rear swivel mount (80) has a transverse hole (82). The shaft (84) of a rear swivel head (83) rotatably mounts in the transverse hole (82). Threaded holes (85) in the rear swivel mount (80) receive set screws (not shown) to hold and restrain the rear swivel head (80) in any of the same manners described above. The rear swivel head (83) has a pivot slot (87) to receive the leg (40). The upper end (71) of the leg (40) has a pivot pin (86) that is received by a hole (90) in the rear swivel head (83). The leg (40) pivots on its pin (86) in the slot (87), allowing the leg (40) to swing in an arc. The rear swivel mount (80) has an axial hole (88). The shaft (92) of a front swivel mount (91) rotatably mounts in the axial hole (88). Threaded holes (89) in the rear swivel mount (80) receive set screws (not shown) to hold and restrain the front swivel mount (91) in any of the same manners described above. The front swivel mount (91) has a transverse hole (93). The shaft (96) of a front swivel head (95) rotatably mounts in the transverse hole (93). Threaded holes (94) in the front swivel mount (91) receive set screws (not shown) to hold and restrain the front swivel head (95) in any of the same manners described above. As seen in FIG. 7, the front swivel head (95) has a pivot slot (98) to receive the leg (41). The upper end (72) of the leg (41) has a pivot pin (99) that is received by a hole (97) in the front swivel head (95). The leg (41) pivots on its pin (99) in the slot (98), allowing the leg (41) to swing in an arc.

Figure 8:
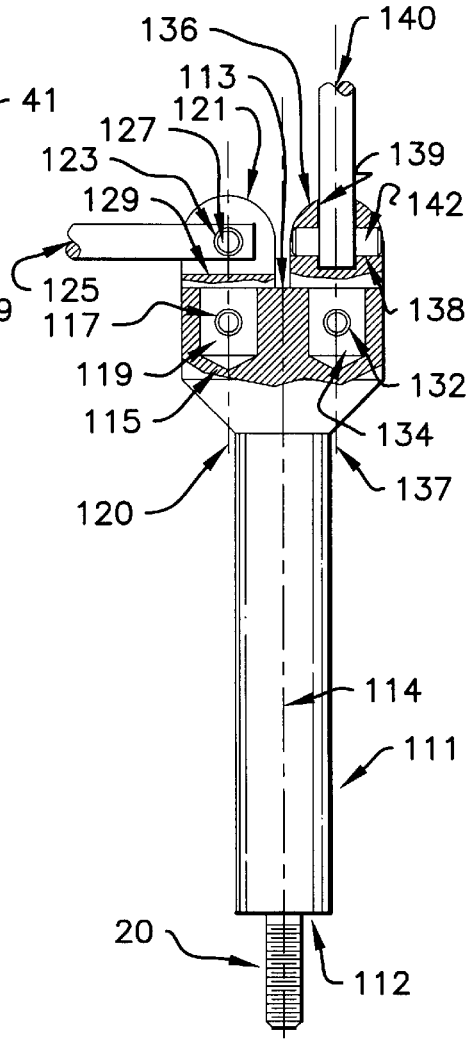
FIG. 8 is a side view of an alternative embodiment of the present invention showing the main body, two swivel heads, and pivotable legs.

FIG. 8 shows an alternative embodiment of the present invention that allows for adjustment in all azimuths. A main body (111) has a rear end (112) and a split front end (113). The rear end (112) attaches to a bow (not shown) using a stud (20), as described above. The split front end (113) has a first hole (115). The shaft (119) of a first swivel head (121) rotatably mounts in the hole (115). Threaded holes (117) in the main body (111) receive set screws (not shown) to hold and restrain the first swivel head (121) in any of the same manners described above for the shaft (33) of the rear collet swivel (36) or the shaft (48) of the front collet swivel (52), as shown in FIG. 2. This arrangement allows the first swivel head (121) to rotate about an axis (120) parallel to the axis (114) of the main body (111). A transverse hole (123) in the first swivel head (121) receives a pivot pin (127) of a first pivoting leg (125). The bottom of a pivot slot (129) in the first swivel head (121) is indicated by a dotted line. The pivot slot (129) permits the first pivoting leg (125) to swing in an arc perpendicular to the axis (120) of the first swivel head (121). Thus, the first swivel head (121) allows the first pivoting leg (125) to rotate in a plane in front of the bow as well as swing in an arc forward and back of the front of the bow. A second pivoting leg (140) is mounted in a similar fashion beside the first pivoting leg (125). A second hole (130) in the split front end (113) of the main body (111) rotatably receives the shaft (134) of a second swivel head (136). The second swivel head (136) rotates about an axis (137) parallel to the axis (114) of the main body (111). Threaded holes (132) in the main body (111) receive set screws (not shown) to hold and restrain the second swivel head (136) in the manner described above. A transverse hole (138) in the second swivel head (136) receives a pivot pin (142) of the second pivoting leg (140), and a pivot slot (139) in the second swivel head (136) allows the second pivoting leg (140) to swing in an arc perpendicular to the axis (137) of the second swivel head (136). As with the first pivoting leg (125), the second swivel head (136) and its pivot slot (139) allow the second pivoting leg (140) to rotate in a plane in front of the bow as well as swing in an arc forward and back of the front of the bow. Thus, by adjusting the first and second pivoting legs (125 and 140), the archer may stand a bow in a vertical position on uneven ground.

Figure 9:
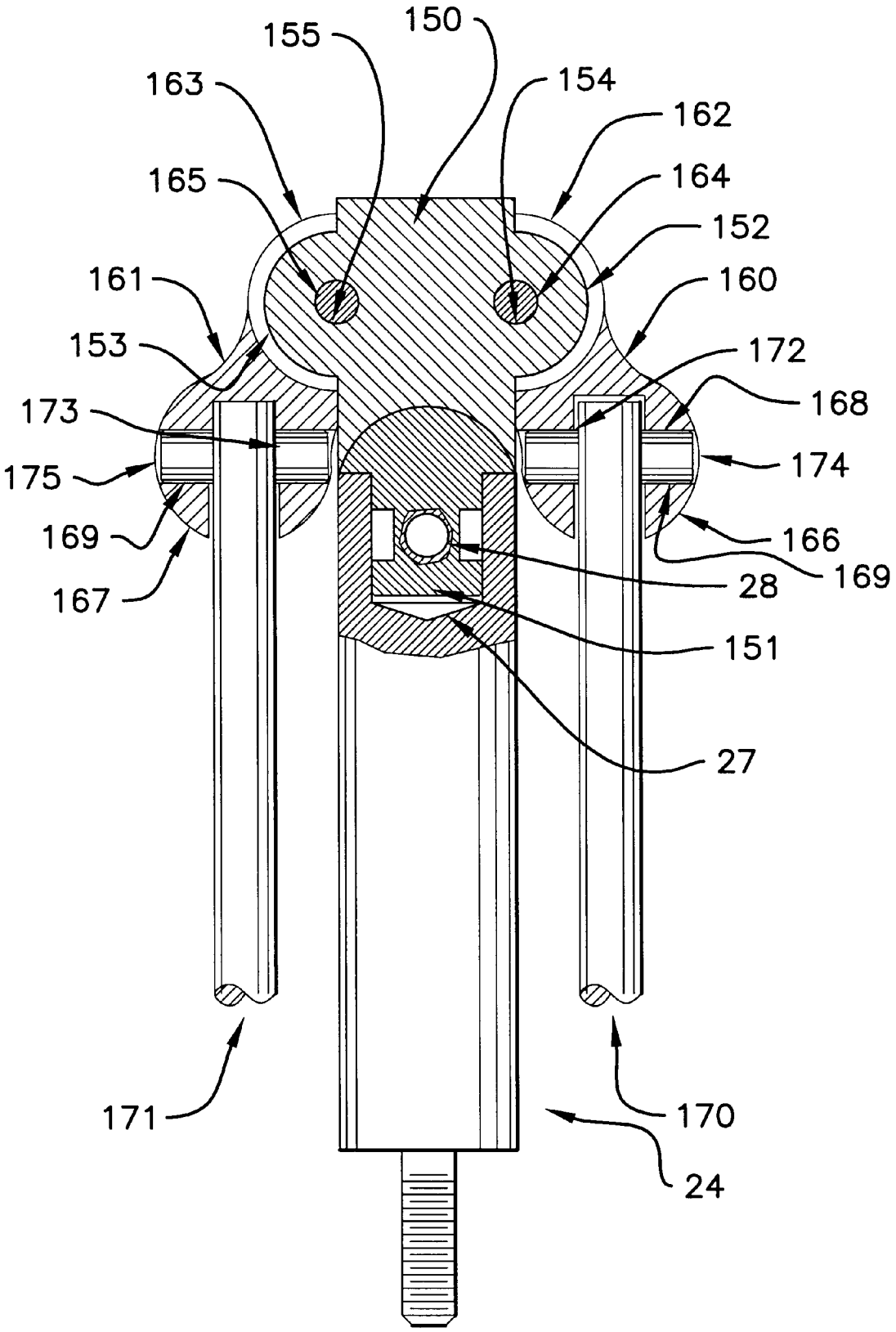
FIG. 9 is a side view of an alternative embodiment of the present invention showing the arrangement of the main body, swivel T-head, swing arms, and pivotable legs.

FIG. 9 shows another embodiment of the invention that allows the legs to be adjusted in all azimuths. A swivel T-head (150) has a shaft (151) that rotatably mounts in an axial hole (27) of the main body (24). Threaded holes (28) receive set screws (not shown) in the manner described above. The swivel T-head (150) has a first tip (152) and a second tip (153). A first swing arm (160) has a pivoting end (162) and a swinging end (166). A pin (164) in the pivoting end (162) of the first swing arm (160) passes through a hole (154) in the first tip (152) of the swivel T-head (150). A transverse hole (168) in the swinging end (166) of the first swing arm (160) receives the pivot pin (174) of a first pivoting leg (170). The first pivoting leg (170) swings in an arc on its pivot pin (174) in a pivot slot (172) in the swinging end (166) of the first swing arm (160). A second swing arm (161) has a pivoting end (163) and a swinging end (167). A pin (165) in the pivoting end (163) of the second swing arm (161) passes through a hole (155) in the second tip (153) of the swivel T-head (150). A transverse hole (169) in the swinging end (167) of the second swing arm (161) receives the pivot pin (175) of a second pivoting leg (171). The second pivoting leg (171) swings in an arc on its pivot pin (175) in a pivot slot (173) in the swinging end (167) of the second swing arm (161). Thus, the swivel T-head (150) may rotate in a first plane in front of the bow, the swing arms (160 and 161) may swing in a second plane perpendicular to the first, and the pivoting legs (170 and 171) may arc in a third plane perpendicular to the second, thereby allowing the legs (170 and 171) to be adjusted in all azimuths.

Figure 10:
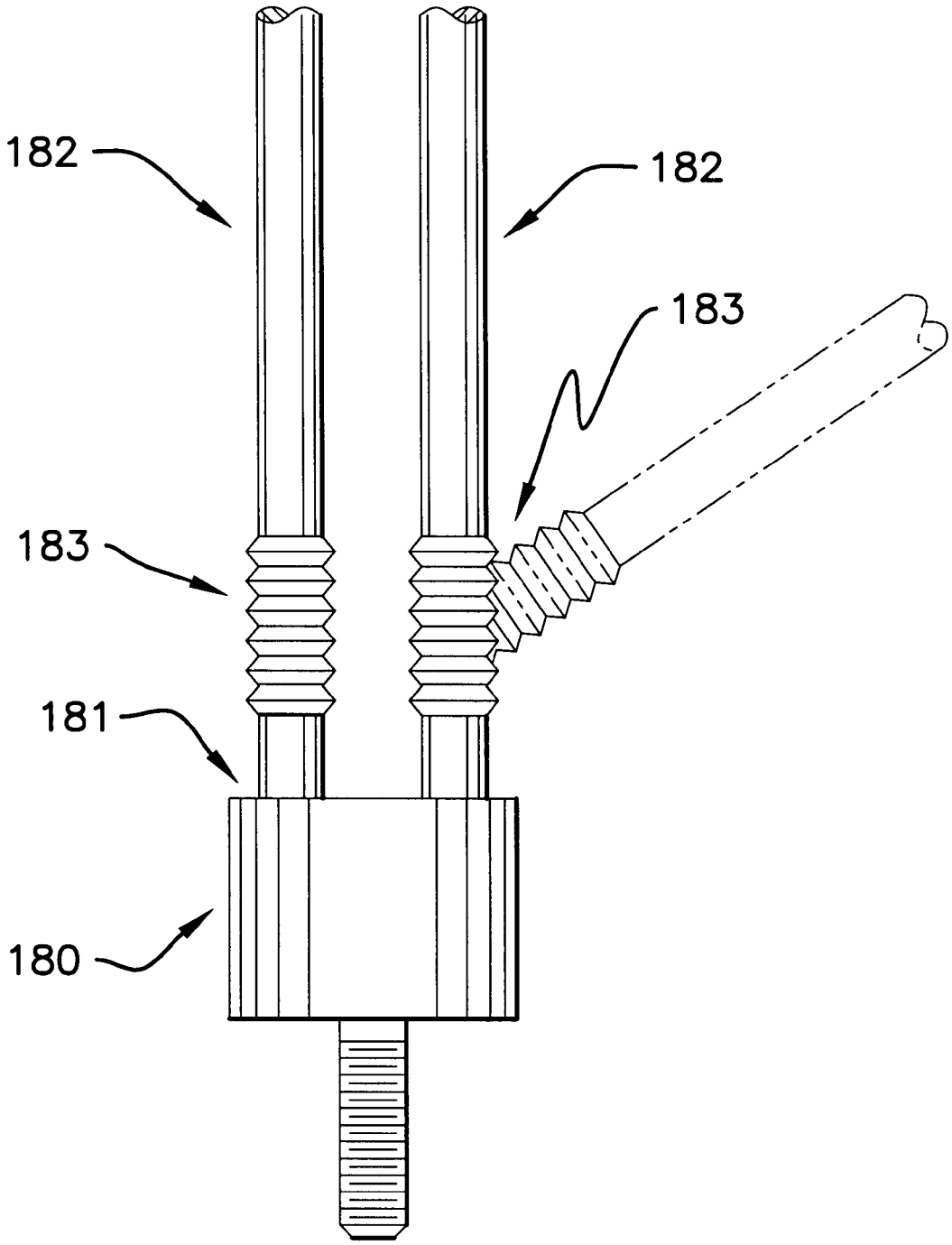
FIG. 10 is a side view of an alternative embodiment of the present invention showing the arrangement of the main body and adjustable legs.

FIG. 10 shows another embodiment of the invention that allows adjustment in all azimuths. A main body (180) attaches to the front of a bow (not shown) in the manner described above. At least two legs (182) are attached to the front end (181) of the main body (180). Each leg (182) has a bendable portion (183) that permits the leg to be bent and remain in any direction. The bendable portion (183) may be made of a metal or plastic that is capable of being repeatedly bent, or it may be made of multiple mechanical joints.

The drawings and description set forth here represent only some embodiments of the invention. After considering these, skilled persons will understand that there are many ways to make an adjustable bow stand according to the principles disclosed. The inventor contemplates that the use of alternative structures, which result in an adjustable bow stand using the principles disclosed and the invention claimed, will be within the scope of the claims.

What we claim is:

1. An adjustable archery bow stand comprising:

a body having an axis and a forward portion, a first swivel having a front end and a rear end, said rear end axially and rotatably mounted to the forward portion of said body, a first leg attached to said first swivel, said first leg extending away from the first swivel in a generally radial direction, a second swivel axially and rotatably mounted to the front end of said first swivel, and a second leg attached to said second swivel, said second leg extending away from the second swivel in a generally radial direction.

2. The adjustable archery bow stand of claim 1 wherein the rear end of said first swivel forms a first shaft and the forward portion of said body forms a first bearing to receive said first shaft for axially and rotatably mounting said rear end of the first swivel to said forward portion of the body.

3. The adjustable archery bow stand of claim 2 further comprising at least one threaded hole directed radially into said body at said first bearing, and a screw received by said threaded hole, said screw being directed toward said first shaft.

4. The adjustable archery bow stand of claim 2 further comprising at least one threaded hole directed radially into said body at said first bearing, a screw received by said threaded hole, a groove formed in said first shaft, and at least one shoe riding in said groove, wherein said screw is directed onto said shoe.

5. The adjustable archery bow stand of claim 1 wherein the second swivel has a back end forming a second shaft and the front end of said first swivel forms a second bearing to receive said second shaft for axially and rotatably mounting said back end of the second swivel to said front end of the first swivel.

6. The adjustable archery bow stand of claim 5 further comprising at least one threaded hole directed radially into said first swivel at said second bearing, and a screw received by said threaded hole, said screw being directed toward said second shaft.

7. The adjustable archery bow stand of claim 5 further comprising at least one threaded hole directed radially into said first swivel at said second bearing, a screw received by said threaded hole, a groove formed in said second shaft, and at least one shoe riding in said groove, wherein said screw is directed onto said shoe.

8. The adjustable archery bow stand of claim 1 wherein at least one of the legs is formed as a telescope to change its length.

9. An adjustable archery bow stand, to stand a bow in a substantially vertical position, comprising:

a bow having a bottom end, and at least two legs, each of said legs having an upper portion and a foot, wherein the upper portion of each of said legs has an adjustable mounting to attach each leg to said bow while permitting each leg to extend away from said bow in more than one direction to form at least an adjustable tripod with the bottom end of said bow and the foot of each leg.

10. The adjustable archery bow stand of claim 9 wherein the adjustable mounting for said legs further comprises:

a body having an axis and a forward portion, the forward portion of said body forming a first bearing, a first swivel having a front end and a rear end, said rear end forming a first shaft received by said first bearing for axially and rotatably mounting the first swivel to the body, and said front end of said first swivel forming a second bearing, a second swivel having a back end, said back end forming a second shaft received by the second bearing of said first swivel for axially and rotatably mounting the second swivel to the first swivel, and wherein the upper portion of each of said legs is attached to said first and second swivels so that said legs extend away from the first and second swivels in a generally radial direction.

11. The adjustable archery bow stand of claim 9 wherein the adjustable mounting for said legs further comprises:

a body having an axis and a forward portion, the forward portion of said body forming a first bearing, a first swivel mount having a front end and a rear end, said rear end forming a first shaft received by said first bearing for axially and rotatably mounting the first swivel mount to the body, and said front end of said first swivel mount forming a second bearing, said first swivel mount further having a first transverse bearing, a second swivel mount having a back end, said back end forming second shaft received by said second bearing for axially and rotatably mounting the second swivel mount to the first swivel mount, and said second swivel mount further having a second transverse bearing, swivel heads, each of said swivel heads having a swivel end and a head portion, said swivel end forming a swivel head shaft, wherein the swivel head shafts of said swivel heads are rotatably received by the first and second transverse bearings of said first and second swivel mounts for rotatably mounting the swivel heads to the first and second swivel mounts, each of said swivel heads further having a pivot slot and a pivot bearing formed in the head portion, and wherein the upper portion of each of said legs has a hip, each of said hips having a transverse pin, wherein each of said transverse pins is received by the pivot bearings of the swivel heads so that the hip of each leg is allowed to pivot in the pivot slot in the head portion of each swivel head.

12. The adjustable archery bow stand of claim 9 wherein the adjustable mounting for said legs further comprises:

a body having a first axis and a twin forward portion, the twin forward portion of said body forming at least first and second bearings aligned in second axes parallel to said first axis, swivel heads, each of said swivel heads having a swivel end and a head portion, each of said swivel ends forming a swivel head shaft, wherein each of said swivel head shafts is rotatably received by the first and second bearings for rotatably mounting the swivel heads to the twin forward portion of said body along said second axes, each of said swivel heads further having a pivot slot and a pivot bearing formed in the head portion, and wherein the upper portion of each of said legs has a hip, each of said hips having a transverse pin, wherein each of said transverse pins is received by the pivot bearing of each swivel head so that the hip of each leg is allowed to pivot in the pivot slot in the head portion of each swivel head.

13. The adjustable archery bow stand of claim 9 wherein the adjustable mounting for said legs further comprises:

a body having an axis and a forward portion, the forward portion of said body having at least two tips, each of said tips having a tip bearing transverse to the axis of said body, swing arms having pivoting ends and swinging ends, each of said pivoting ends having a pivot end slot and a journal, each of said journals received by the tip bearings, and said pivot end slots allowing said swing arms to pivot on the tips of the forward portion of said body, and each of said swinging ends having a swing end bearing and a swing end slot, and wherein the upper portion of each of said legs has a hip, and each said hip has a transverse pin, said transverse pins of said legs received by the swing end bearings so that the hips are allowed to pivot in the swing end slots of the swinging ends of said swing arms.

14. The adjustable archery bow stand of claim 9 wherein the adjustable mounting of the upper portion of each of said legs is a flexible material that allows the leg to be bent and remain in any direction.

15. The adjustable archery bow stand of claim 14 wherein the flexible material is selected from the group consisting of bendable metal or plastic.

16. The adjustable archery bow stand of claim 9 wherein at least one of the legs is formed as a telescope to change its length.

17. An adjustable archery bow stand, to stand a a bow in a substantially vertical position, comprising:

a bow having a bottom end, and at least two legs, each of said legs having an upper portion and a foot, wherein the upper portion of each leg is connected to a means for adjustably mounting each leg to said bow so that each leg may extend away from said bow in more than one direction to form at least an adjustable tripod with the bottom end of said bow and the foot of each leg.

18. The adjustable archery bow stand of claim 17 wherein at least one of the legs is formed as a telescope to change its length.

* * * * *